United States Patent [19]

Wilson

[11] Patent Number: 5,071,129

[45] Date of Patent: Dec. 10, 1991

[54] PUTTING PRACTICE DEVICE

[76] Inventor: Clyde W. Wilson, 723 W. North St., Grayville, Ill. 62844

[21] Appl. No.: 666,597

[22] Filed: Mar. 8, 1991

[51] Int. Cl.[5] ..... A63B 69/36

[52] U.S. Cl. ..... 273/183 D; 273/163 R

[58] Field of Search ..... 273/163 R, 163 H, 183 D, 273/194 R, 194 A, 35 A, 186 A, 186 C

[56] References Cited

U.S. PATENT DOCUMENTS 1,327,171 1/1920 Ruggles ..... 273/163 R 3,170,698 2/1965 Schoeffler et al. ..... 273/194 A X 4,053,160 10/1977 Salata ..... 273/194 R X 4,204,332 5/1980 Gray ..... 273/183 D X

*Primary Examiner*—George J. Marlo

*Attorney, Agent, or Firm*—John Gibson Semmes

[57] ABSTRACT

A golf putting visual aid practice and sighting instrument characterized by its removable attachment to a conventional putter wherein a reflective device is articulably connected rearwardly of a putter head and blade. The reflective device mounts a line of sight marker which may be shifted transversely at the option of the golfer to perfect the relative position of the putter club head to the green and to the target hole.

2 Claims, 2 Drawing Sheets

PUTTING PRACTICE DEVICE

BACKGROUND OF THE INVENTION

The invention is adapted to removable disposition on the shank of a conventional putter for use by a golfer in adjusting inadequacy in his vision as between the putter and the hole, which may or may not be targeted by the green pin. It is adaptable to align the putter to the intended line of sight whether or not the putter blade may be open at the toe or closed, relative to the line. In addition the instrument can be used to check "break". For example, if the golfer has to raise the putter heel to make the hole appear level, it is known that the break of the green is to the right of the line of the intended putt. On the other hand, when one has to raise the toe of the putter before the target hole appears level, then it is known that the break is to the left of the intended line of the putt. In use of this instrument, the hole may be viewed at near ground level with the instrument and the ball lined up with the sighting mechanism, immediately preceding striking the ball. In practice the vertical sighting mechanism, which is a part of the overall instrument, is aligned with the soot on the putter where the individual player prefers to strike the ball which may or may not be the "sweet spot" highlighted by the putter manufacturer.

Additionally, the present instrument which is mirror-reflective, preferably at ground level, teaches the player to see the "cut of the grass. Thus, he may accurately ascertain that when the grass is bent toward the ball and away from the hole, the "roll" of his ball will be slower. Conversely, if the cut is observed by reflection to be bent away from the ball and toward the hole, the roll of the ball is going to be faster, etc. Accordingly, the present instrument offers assistance in direction, break and speed of the green. It thus teaches eye-muscle coordination that becomes second nature on the putting green after the instrument has teen detached from the putter. Not only is the device provided with universal quick connect and disconnect means, but also the lightness in weight of the instrument is such as to create no appreciable alteration in the "feel" of the putter. The device is manufactured of durable acrylic polymers requiring minimal care and providing substantial durability. Its primary function is to enhance the eye-muscle coordination which is required to effect accurate putting through the determination of stroke, speed, break, etc.

SUMMARY OF THE INVENTION

The visual sighting aid has as its primary objective the enhancement of putting skills through adaptation of the instrument to a conventional putter. Every golfer knows, it is important to obtain a near perfect line between the ball and the hole or flag of the green, irrespective of varying conditions of the "break" and "cut" of the green. The golfer herein is given the option of adjusting his sight by means of the combination mirror and the unique sighting device which allows him/her to direct the putter precisely to the target line. It is known as a Putterscope which is effectively a type of scope that gives the golfer an eyeball line of sight from his putter across the green, to the target hole.

THE PRIOR ART

Here follows a listing of the known prior art as it relates to putting aids adapted to conventional golf club putters.

| INVENTOR | U.S. Pat. No. |
|---|---|
| Lepera | 4,598,911 |
| O'Flanagan | 4,601,472 |
| Logsdon | 4,839,968 |
| Fukumochi | 4,919,424 |
| Bang | 4,953,866 |

In none of the above is the combination of applicant's detachable cutting instrument shown or described. The present combination of universally adjustable mirror with shiftable line of sight marker is unique, to the field of development.

THE DRAWINGS

FIG. 4 A is a top plan view of the mounting arm connecting the reflective bracket to the clamp anchor;

FIG. 4 B is a top plan view of the mounting arm clamp, per se;

FIG. 4 C is a front elevation of the reflector bracket, less the slideable sight;

FIG. 4 D is a side elevation of the slideable sight detached from the bracket of FIG. 4 C.

DESCRIPTION OF PREFERRED EMBODIMENT

Figure 1:
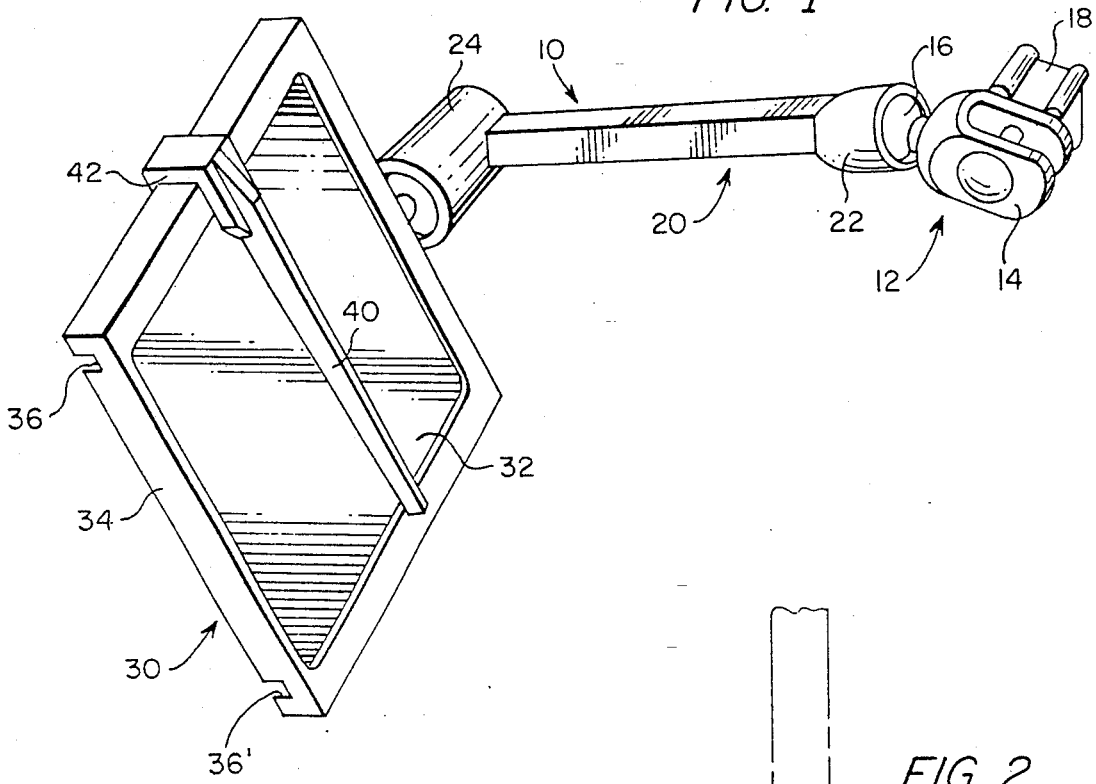
FIG. 1 is a view in perspective of the invention.
Figure 2:
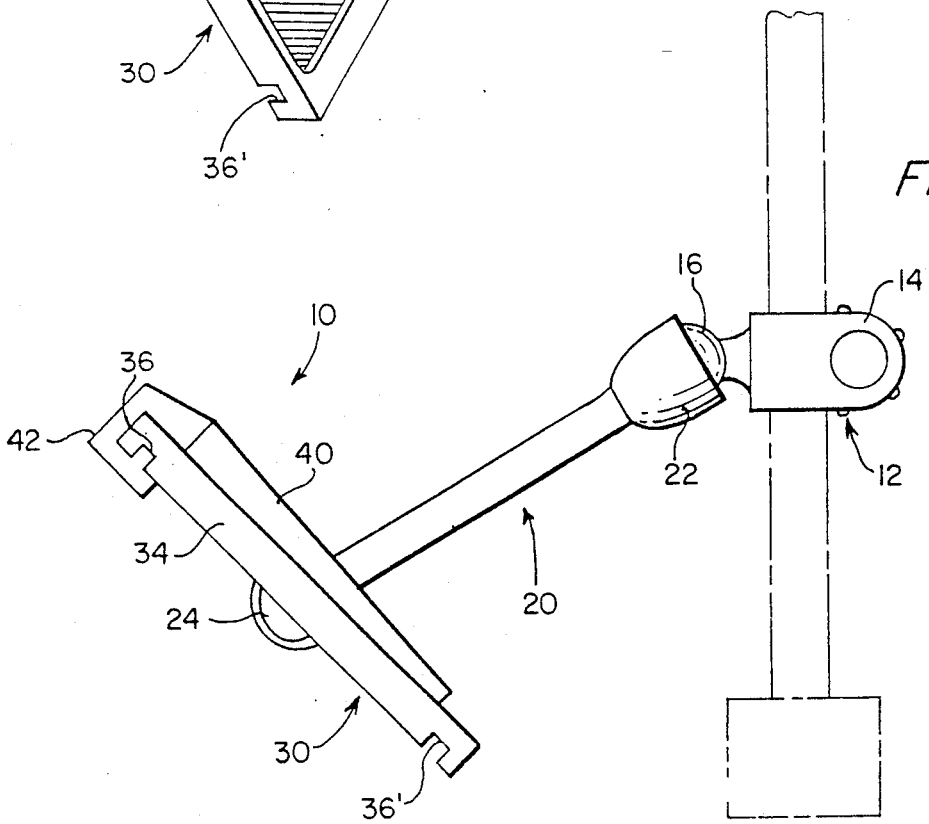
FIG. 2 is a view in side elevation of the invention showing its relation to the putter in a raised position, relative to the putter head and the ground.
Figure 3:
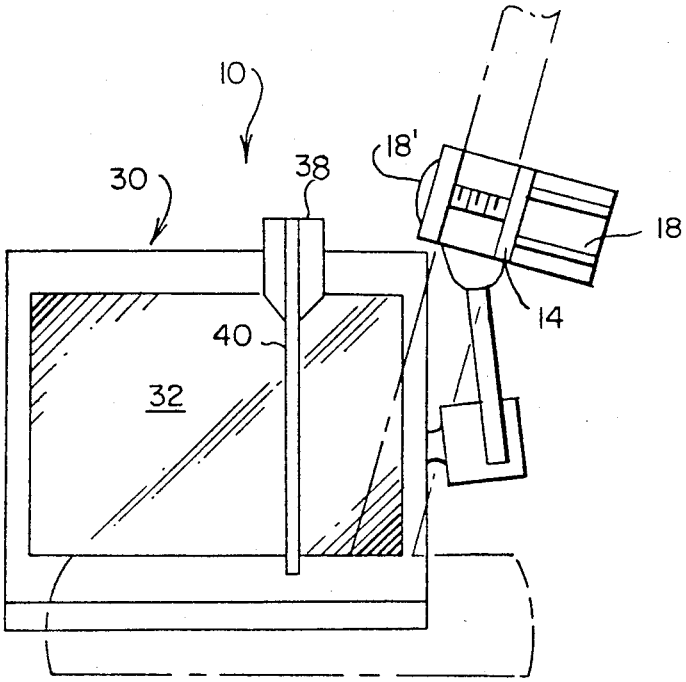
FIG. 3 is a view of the device in front elevation.
Figure 4B:
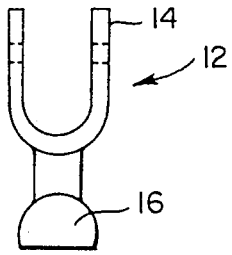
Figure 4A:
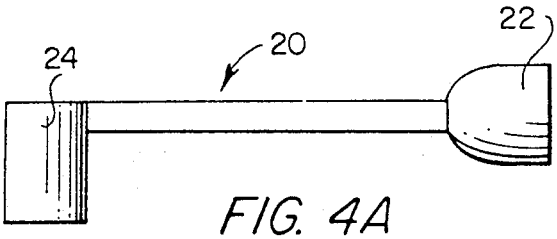
Figure 4D:
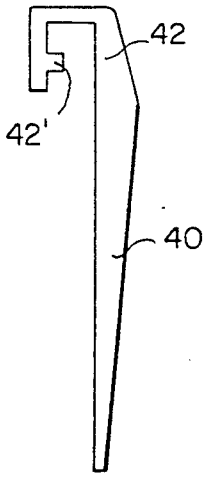
Figure 4C:
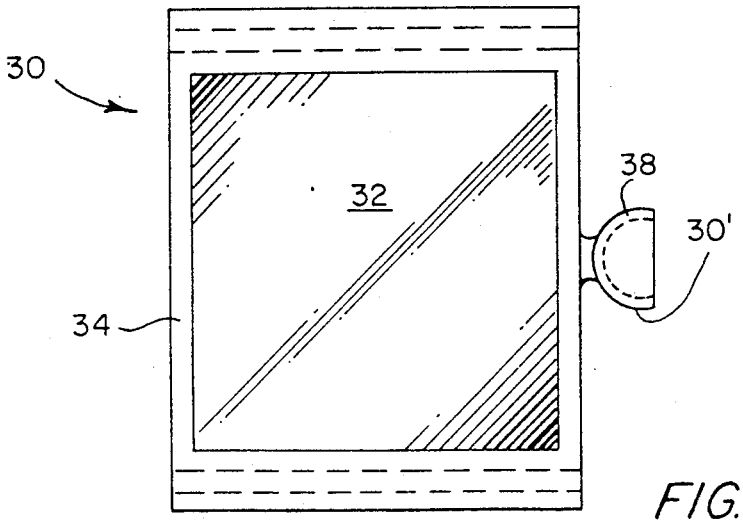

Referring to FIG. 1, the assembled scope 10, is shown detached from the putter golf club. The scope 10 is adapted to be adjustably secured to the putter by means of a clamp 12, wherein U-shaped clamp extension 14 defines at its inner end an attachment ball 16 and at its outer end a clamping knob and screw assembly 18—18'. See FIG. 4 A. The knob and screw pass through open ends of the clamp to secure and release it against the club shaft, as shown in FIG. 2. Mounting arm 20 engages the clamp 12 by means of its socket 22. Clamp mounting arm 20 is also provided with a socket 24 which is disposed at a right angle to the mounting arm. See FIG. 4 A. This socket is adapted to engage the corresponding ball of the mirror bracket 30 as indicated in FIG. 1. All ball and socket joints are snap-lock and articulable giving optional positioning of the drive almost universally with respect to the putter club shown in phantom, FIGS. 2 and 3.

The mirror bracket, it will be noted, contains the reflective glass 32 within case 34, said case having horizontally cut mortise 36 and 36'. See FIG. 4 C. Substantially midway of the scope reflector and the bottom of case 34 a fixed mounting ball 38 is provided to mate with corresponding socket 24 of the mounting arm.

Line of sight marker 40 is slideably mounted in mirror bracket 30 by engagement of tenon 42' with the mortise track 36 of said bracket. The marker is bent upon itself at its top 42 to provide the overriding shiftable connection with case 34. See FIG.4 D. There is thus a fiction fit between the tenon 42' and mortise so that when the marker 40 is set transversely, it will retain its position until forcibly moved again. As indicated heretofore, transverse adjustment of marker 40 permits a personalized adjustment to the line-of-sight, relative to the "sweet spot" of the blade, the ball and a target hole, should the golfer desire to deviate from the normal line-of-sight. Also, to insure getting the eyes directly over the ball, the golfer may rotate his mirror glass 32 so it is directed upward and parallel with the putting surface. Using the line-of-sight marker 40, pointing it toward the preferred striking surface of the putter while bisecting the ball, when the golfer looks down into the mirror, he will see the marker bisecting his own eyes—whereupon he is assured of being exactly "over the ball".

I claim:

1. The combination with a golf putter club having a head with blade and shank; a golf practice scope, comprising:

A) a reflector case and reflector therein interconnected to the base of the shank of the club for spaced positioning in-line with the blade of the putter club head;

B) a movable line-of-sight marker overlying the case;

C) an adjustable clamp assembly for the case, said assembly being engagable at a near end with the putter club shank;

D) an articulable arm connected at a near end thereof to a far end of the clamp assembly and having connection at a far end to the reflector case; said arm, clamp and reflector case providing ball and socket joint connections therebetween, whereby the scope may be adjustably mounted in vertical, horizontal and in-between angular relationship to the club shank, the blade of the head and to a putting green surface.

2. The golf practice scope of claim 1 wherein the line-of-sight marker is secured in transversely slideable relation to the reflector case, whereby a golfer may adjust the line-of-sight relative to the sweet spot of the blade, the ball and a target hole.

* * * * *